United States Patent [19]

Bräuer et al.

[11] Patent Number: 4,747,987

[45] Date of Patent: May 31, 1988

[54] PROCESS FOR THE PRODUCTION OF FILLER-CONTAINING ACRYLIC AND MODACRYLIC FIBERS

[75] Inventors: Wolfgang Bräuer, Cologne; Bernd Willenberg, Bergisch-Gladbach; Siegfried Korte, Leverkusen; Carlhans Süling, Odenthal, all of Fed. Rep. of Germany

[73] Assignee: Bayer Aktiengesellschaft, Leverkusen, Fed. Rep. of Germany

[21] Appl. No.: 903,329

[22] Filed: Sep. 3, 1986

Related U.S. Application Data

[62] Division of Ser. No. 797,100, Nov. 12, 1985, Pat. No. 4,643,946.

[30] Foreign Application Priority Data

Nov. 30, 1984 [DE] Fed. Rep. of Germany ..... 3443680

[51] Int. Cl.[4] ..... D01F 6/18

[52] U.S. Cl. ..... 264/182; 264/101; 264/206; 264/211; 264/210.8; 264/210.6; 264/211.12; 106/287.14; 106/287.16; 528/10; 528/25; 528/28

[58] Field of Search ..... 264/184, 206, 210.8, 264/211, 182, 210.6, 211.12, 101; 106/165, 198, 18.11, 237, 238, 239, 287.14, 287.16; 528/10, 25, 28

[56] References Cited

U.S. PATENT DOCUMENTS

| | | | |
|---|---|---|---|
| 2,879,546 | 3/1959 | Hemphill | 264/211 |
| 2,888,419 | 5/1959 | Safford | 264/211 |
| 3,632,715 | 1/1972 | Gowdy et al. | 264/211 |
| 4,136,132 | 1/1979 | Poole | 264/211 |
| 4,273,691 | 6/1981 | MacLaury et al. | 106/18.11 |

FOREIGN PATENT DOCUMENTS

| | | | |
|---|---|---|---|
| 53-39360 | 4/1978 | Japan | 264/211 |
| 59-102931 | 6/1984 | Japan | 264/211 |
| 0696068 | 11/1979 | U.S.S.R. | 264/211 |

*Primary Examiner*—Jan H. Silbaugh
*Assistant Examiner*—Hubert C. Lorin
*Attorney, Agent, or Firm*—Sprung Horn Kramer & Woods

[57] ABSTRACT

Silica-containing acrylic and modacrylic fibres are obtained without spinning defects in that an aqueous silica sol is reacted with a silane and with a polar organic solvent, the sequence in which the two agents are added being optional, the water is distilled off in a vacuum at a temperature of at most 60° C., the thread-forming polymer is then added in a quantity which is sufficient to form a spinnable solution and the solution is spun.

8 Claims, No Drawings

PROCESS FOR THE PRODUCTION OF FILLER-CONTAINING ACRYLIC AND MODACRYLIC FIBERS

This is a division of application Ser. No. 797,100 filed Nov. 12, 1985, now U.S. Pat. No. 4,643,946.

BACKGROUND OF THE INVENTION

The invention relates to filler-containing acrylic and modacrylic fibres and a process for the production thereof in which silane-modified silica sols are reacted together with the fibre raw material under specific processing conditions to form a spinnable solution, and this solution is spun.

It is already known to disperse inorganic materials in organic solvents and then to spin them together with acrylonitrile copolymers (DE-OS No. 32 44 028). The filler-containing fibres produced in this way demonstrate reduced flammability and are suitable as reinforcing fibres in building materials or friction materials (brake and clutch linings). In the formerly known processes, the production of a stable dispersion of the highly dispersed solid inorganic filler in the organic medium is accompanied by considerable problems so that expensive apparatus such as high-speed dispersion apparatuses, extruders or bead mills have to be used for the dispersion operation.

SUMMARY OF THE INVENTION

An aim of the invention was to provide a simple process which dispensed with the expensive dispersion apparatus.

This aim is surprisingly achieved in that an aqueous silica sol is reacted with silane and with a polar organic solvent, the sequence in which the two agents are added being optional, the water is distilled off under vacuum at a temperature of at most 60° C., then the thread-forming acrylonitrile polymer is added in a quantity which is sufficient for a spinable solution and the solution is spun.

An object of the invention is therefore acrylic and modacrylic fibres containing from 5 to 50% by weight, based on total solids, of silica, characterised in that the silica is an amorphous silica which does not tend to aggregate having a particle diameter distribution of from 10 to 50 nm containing from 0.1 to 10% by weight, preferably from 0.3 to 5% by weight, based on pure silica, of an organosilane and optionally also from 0.1 to 10% by weight of a surface-fixed polymer.

An object of the invention is also a process for the production of silica-containing acrylic and modacrylic fibres from a solution of thread-forming acrylonitrile polymer in a polar organic solvent which also contains finely divided silica, by producing a solution, spinning by a dry or wet spinning process and conventional aftertreatment, for example by washing, brightening, drawing, crimping and cutting, which is characterised in that an aqueous silica sol of an amorphous silica which does not tend to aggregate and has a particle diameter distribution of from to 10 to 50 nm is reacted in any sequence with 0.1 to 10% by weight, based on silica solid, of a silane and with a one-fold to five-fold quantity based on silica sol, of polar organic solvent, the water is distilled off under vacuum at a temperature of at most 60° C., in that thread-forming polymer is added in a quantity which is sufficient for a spinnable solution, the solution is spun and the threads are drawn 1:6 to 1:12, optionally in several stages, in the course of the after treatment.

The concentration of the polymer in the spinning solution is from 10 to 35% by weight, based on the spinning solution without filler, preferably from 15 to 30% by weight.

Acrylic and modacrylic fibres containing from 5 to 50% by weight of silican can thus be produced.

The sols used are aqueous colloidal silica solutions. They contain uncross-linked spherical particles of high purity amorphous silica. The diameter of the particles lies in the colloidal range and is from about 10 to 50 nm. They are formed by condensation of even smaller particles or of molecular silica.

The intended and controllable synthesis of the anionically active sols used produces silica particles of equal size and of low internal porosity in aqueous media and, after changing the sol, also in specific organic media (preferably in dimethylformamide). These silica particles do not combine to form larger secondary particles owing to the special production conditions. When they are introduced into spinning solutions of acrylic and modacrylic polymers, this leads to a particularly uniform distribution of the silica filler and, after the spinning operation, to acrylic and modacrylic fibres having high filler contents. With this procedure, filler is distributed uniformly and in colloidal dimensions in the fibre.

Silica preparations obtained by other processes, for example silicas formed by flame hydrolysis are characterised by stronger aggregate formation owing to their particular surface structure. The particles primarily formed (about 10 nm) do not exist predominantly in isolation from each other as individual particles. Instead, several of them coalesce to form chain-form aggregates. These aggregates can in turn easily combine later on owing to the strong interactions through hydrogen bonds to form greater three dimensional associations (1–200 μm). These aggregates can be temporarily divided by the effect of shearing forces. On completion of the dispersion process, the said three-dimensional framework structures are re-formed depending on the silica concentration.

The silica sols generally contain from 10 to 50% by weight of silica.

Dimethylformamide and dimethylacetamide are preferably used as polar organic solvent. It has been found that the aqueous silica sol does not coagulate during the reaction with the organic solvent and when distilling off the water, optionally using an entrainer such as toluene, and exists as a stable organic silica sol after this treatment. This organic silica sol preferably contains from 10 to 20% by weight of solid material and can be further stabilized by an acid, for example concentrated sulphuric acid, i.e. adjusted to a pH of 1 to 4.

The silanes used correspond to the formulae

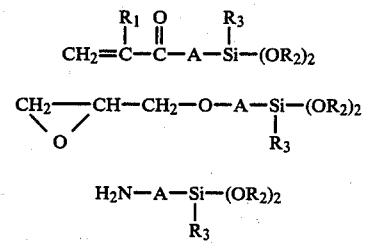

wherein $R^1$ represents H or $CH_3$, $R^2$ represents a straight-chained or branched $C_1$–$C_4$ alkyl or phenyl, $R^3$ represents $OR_2$ or $R_2$ and A represents a straight-chained or branched $C_1$–$C_6$-alkylene.

γ-methylacryloxypropyltrimethoxysilane, γ-glycidyloxypropyltrimethoxysilane or γ-aminopropyltriethoxysilane are preferably used as silane. The reaction of the silica sol with the silane is carried out at from 20° to 80° C. and requires about 0.1 to 3 hours. The silane modification of the silica sol is preferably carried out after charging the sol and distilling off the water before addition of the acrylic fibre raw material.

A further method of modifying the surface for the silicas used involves bonding the silica particles, after applying the organosilanes, via the functional groups thereof with polymers in quantities of from 0.1 to 10.0% by weight, based on the filler used. This is effected either by subsequent polymerisation, if the organosilane contains polymerisable groupings, or by the direct bonding of polymers which are soluble in the spinning solvent in the form of a polymer-analogue reaction. Other polymers which differ from the fibre-forming acrylic polymers can also be used in this way for additional surface modification of the silicas. It is important that the originally present number and size distributions of the silica particles are substantially maintained during these reactions.

Subsequent radical polymerisation enables the fillers used to be varied in many ways by altering polymers which are derived from ethylenically unsaturated compounds, in particular from acrylic acid esters and methacrylic acid esters.

Hydroxyl or amino group-containing vinyl polymers which are soluble in the spinning solvent, for example, as well as polyamides, polyesters or polyethers with terminal hydroxyl or amino groups can be bonded to the silane-modified silica surfaces by a polymer-analogue reaction.

Any conventional acrylic and modacrylic fibre raw materials may be used. The use of acrylonitrile homopolymers having a K value above 70 (see Fikentscher, Cellulosechemie 13 (1932) page 58 for definition of K values) is preferred.

When preparing the solution, it is preferable to introduce the thread-forming polymer into the organic silica sol at room temperature and then to heat up the dispersion formed. The silica sol does not affect the dissolving properties, i.e. the dissolving times and dissolving temperatures of the acrylonitrile polymer. Filtration of the spinning solution and subsequent spinning can be carried out without difficulties. Blockages were not observed.

EXAMPLES

EXAMPLE 1

3 kg of an aqueous silica sol containing 900 g of $SiO_2$ with a particle diameter of from 15 to 20 nm were reacted with 2 kg of dimethylformamide DMF1. During the continuous addition of a further 6 kg of DMF with simultaneous vacuum distillation of a water/DMF mixture, the aqueous sol phase was converted into a DMF sol phase and the temperature of the sol did not exceed 60° C. 4.5 kg of DMF silica sol were obtained, containing 900 g of $SiO_2$ and having a refractive index $n_D^{20}=1.4300$, corresponding to a water content of <1% by weight. The organic silica sol was stabilized with 27 g of concentrated sulphuric acid (sol 1).

EXAMPLE 2

Sol 1 was reacted with 18 g of γ-methacryloxypropyltriemethoxy silane and was stirred for 2 hours at 60° C. A carbon analysis of a sample of the product freed from the solvent produced 0.45% by weight of carbon (sol 2).

EXAMPLE 3

Sol 1 was reacted with 18 g of γ-glycidyloxypropyltrimethoxysilane and stirred for 2 hours at 60° C. The carbon analysis of a sample freed from the solvent produced 0.65% by weight of carbon (sol 3).

EXAMPLE 4

2.8 kg of an aqueous silica sol containing 840 g of $SiO_2$ were stirred for 1 hour with 2 kg of distilled water and 33.6 g of the γ-aminopropyltriethoxysilane. The aqueous sol was then converted into a DMF sol using 8 kg of DMF in accordance with Example 1. 5310 g of modified DMF sol were obtained. The carbon analysis of a sample freed from the solvent produced 1.2% by weight of carbon. The sol was adjusted to pH 1.5 using concentrated sulphuric acid (sol 4).

EXAMPLE 5

1056 g of sol 2 were reacted with 5583 g of DMF and cooled to 0° C. 1920 g of an acrylonitrile homopolymer having a K-value of 90 were introduced into this starting material with stirring. The polymer was dissolved within 90 minutes under stirring and heating to 85° C. The solution was filtered through a metallic fibrous filter having a pore width of 40 μm and had a viscosity of 137 Pa.s at 30° C.

The solution was dry spun at 85° C. through a 60 hole die having a die hole diameter of 0.2 mm. The shaft temperature was 200° C. and the spinning air temperature 250° C. An individual spinning titre of 10.8 dtex was produced at a take-off speed of 250 m/min. The spun product was drawn 10.3-fold in saturated steam at 120° C. and fixed at 200° C. without allowing shrinkage.

The individual fibre data are a titre of 1.0 dtex, a fibre strength of 5.4 cN/dtex, a breaking elongation of 12.6%, an initial modulus of 130 cN/dtex and a boiling shrinkage of 3.9%.

EXAMPLE 6

2.2 kg of sol 2 were diluted with 4.48 kg of DMF and cooled to 0° C. 1.76 kg of acrylonitrile homopolymer according to example 5 were introduced with stirring. The spinning solution prepared according to example 5 had a viscosity of 84 Pa.s at 30° C. and was dry spun according to Example 5. The individual spinning titre was 13.5 dtex. After 10.2-fold drawing and fixing, the following fibre data were produced: a titre of 1.16 dtex, a strength of 4.6 cN/dtex, a breaking elongation of 13.1%, an initial modulus of 120 cN/dtex and a boiling shrinkage of 4.1%.

EXAMPLE 7

A spinning solution having a viscosity of 89 Pa.s at 30° C. was produced from 4625 g of sol 2, 3260 g of DMF and 1850 g of a polyacrylonitrile homopolymer according to Example 5. The solution was dry spun at 80° C. at a take off rate of 250 m/min. The individual fibre spinning titre was 13.6 dtex. The spun product was drawn 7.75 fold in saturated steam and fixed at 200° C. in accordance with Example 5. The fibre data are: a titre of 1.76 dtex, a strength of 3.0 cN/dtex, a breaking elongation of 17.9%, an initial modulus of 75 cN/dtex and a boiling shrinkage of 4.2%.

EXAMPLE 8

As in Example 5, a spinning solution was produced from 4375 g of sol 3, 1313 g of DMF and 1750 g of a copolymer of 86% by weight of acrylonitrile and 14% by weight of acrylic acid (K-value 90). The solution had a viscosity of 9o Pa.s at 30° C. and was spun at a take-off rate of about 20 m/min. An individual fibre spinning titre of 18.2 dtex was produced.

The spun product was drawn 14.8 fold in saturated steam, fixed at 115° C. in saturated steam and fixed in a dryer at 200° C. while allowing shrinkage.

The fibre data are a titre of 1.2 dtex, a strength of 3.2 cN/d tex, a breaking elongation of 21.9%, an initial modulus of 72 cN/dtex and a boiling shrinkage of 12%.

EXAMPLE 9

As in Example 5, a solution was produced from 4.8 kg of sol 4, 480 g of DMF and 1440 g of a copolymer of 86% by weight of acrylonitrile and 14% by weight of acrylic acid.

The spinning solution having a viscosity of 169 Pa.s at 30° C. was dry spun at 85° C. at a take-off rate of 200 m/min. A spinning titre of 18.4 dtex was produced. The spun product was drawn 6-fold in boiling water and after-drawn 1.38-fold at 150° C. and finally fixed at 190° C. The following fibre data were produced: a titre of 2.2 dtex, a strength of 2.7 cN/dtex, a breaking elongation of 15%, an initial modulus of 63 cN/dtex and a boiling shrinkage of 32%.

EXAMPLE 10

As in Example 5, a spinning solution having a viscosity of 65 Pa.s was produced from 4625 g of sol 2, 1689 g of DMF and 1850 g of a copolymer of 93.5% by weight of acrylonitrile, 5.9% by weight of methylacrylate and 0.6% by weight of sodium methallyl sulphonate (K-value 80).

As in Example 5, this solution was spun at 50° C. at a take-off rate of 250 m/min. The individual fibre spinning titre was 16.3 dtex. The spun product was drawn 6-fold in boiling water and then subsequently drawn 1.6-fold at 155° C. The following fibre data were produced: a titre of 1.7 dtex, a strength of 2.3 cN/dtex, a breaking elongation of 8%, an initial modulus of 62 cN/dtex and a boiling shrinkage of 22%.

EXAMPLE 11 (Comparison Example)

Example 10 was repeated with the non-silanized sol 1. The spinning solution had a viscosity of 75 Pa.s at 30° C. Numerous tears were produced at a degree of drawing of 4.0 so drawing according to Example 10 was not possible.

EXAMPLE 12

3560 g of a sol produced according to Example 1 with 800 g of $SiO_2$ content was stirred with 16 g of the silane according to Example 2, 24 g of methylacrylate and 0.96 g of azoisobutyric acid nitrile for 2 hours at 60° C. The carbon analysis produced a value of 1.35% by weight of carbon (sol 5) for a sample freed from solvent.

EXAMPLE 13

According to Example 5, a spinning solution having a viscosity of 60 Pa.s at 30° C. was produced from 1956 g of sol 5, 1604 g of DMF and 880 g of a copolymer of 93.5% by weight of acrylonitrile, 5.9% by weight of methylacrylate and 0.6% by weight of sodium methallyl sulphonate (K-value 80).

The solution was spun at 60° C. and at a take-off rate of 200 m/min. The individual fibre spinning titre was 17.6 dtex.

The spun product was drawn 7-fold in boiling water and produced the following individual fibre data: a titre of 2.5 dtex, a strength of 2.3 cN/dtex, a breaking elongation of 9%, an initial modulus of 61 cN/dtex and a boiling shrinkage of 24%.

we claim:

1. In a process for the production of silica-containing acrylic and modacrylic fibers, without spinning defects from a solution of a thread-forming acrylonitrile polymer in a polar organic solvent, which additionally contains finely divided silica particles by said solution into threads spinning by a dry or wet spinning process and subsequently after-treating said threads, the improvement comprising reacting an aqueous silica sol of an amorphous silica, which does not tend to aggregate and has a particulate diameter distribution of from 10 to 50 nm, in any sequence, with from 0.1 to 10% by weight, based on silica sol solid, of a silane, said silane selected from the group consisting of

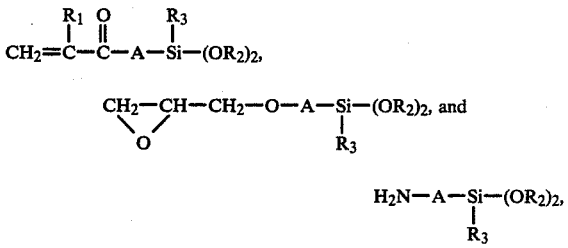

wherein $R^1$ represents H or $CH_3$, $R^2$ represents a straight-chained or branched $C_1$–$C_4$ alkyl or phenyl, $R^3$ represents $OR_2$ or $R_2$, and A represents a straight-chained or branched $C_1$–$C_6$-alkylene, and with a one to five-fold quantity, based on silica sol, of the polar organic solvent, distilling off water under vacuum at a temperature of at most 60° C., adding the thread-forming polymer in a quantity which is sufficient to form a spinnable solution, spinning the solution into threads and drawing said threads in a ratio of 1:6 to 1:12 in the course of the after treatment.

2. Process according to claim 1, wherein the solvent is diemthylformamide or dimethylacetamide.

3. Process according to claim 1, wherein the polymer in the spinnable solution is in a concentration of from 10 to 35% by weight based on the spinnable solution without filler.

4. A process according to claim 1, wherein the silane is selected from the group consisting of
γ-methylacryloxypropytrimethoxysilane,
γ-glycidyloxypropyltrimethoxysilane, and
γ-aminopropyltriethoxysilane.

5. A process according to claim 1, wherein the reaction between the silica sol and the silane is carried out at 20° C. to 80° C.

6. A process according to claim 1, wherein the reaction between the silica sol and the silane is carried out for 0.1 to 3 hours.

7. A process according to claim 1, wherein the reaction between the silica sol and the silane is conducted after charging the sol and the distilling off water is conducted before addition of the acrylonitrile.

8. A process according to claim 1, which further comprises bonding the silica particles to said polymer via functional groups of the silica after applying the silane.

* * * * *

UNITED STATES PATENT AND TRADEMARK OFFICE

CERTIFICATE OF CORRECTION

PATENT NO. : 4,747,987

DATED : May 31, 1988

INVENTOR(S) : Wolfgang Bräuer, et al

It is certified that error appears in the above-identified patent and that said Letters Patent is hereby corrected as shown below:

| | |
|---|---|
| Col. 3, line 61 | Delete "DMFl." and substitute --(DMF).-- |
| Col. 5, line 13 | Delete "90 Pa.s" and substitute --99 Pa.s-- |
| Col. 6, line 20 | After "defects" insert --,-- |
| Col. 6, lines 24-25 | Delete "said solution into threads spinning" and substitute --spinning said solution into threads-- |

Signed and Sealed this

Thirteenth Day of December, 1988

*Attest:*

*Attesting Officer*

DONALD J. QUIGG

*Commissioner of Patents and Trademarks*